US011107669B2

(12) United States Patent
Doroshenko et al.

(10) Patent No.: US 11,107,669 B2
(45) Date of Patent: Aug. 31, 2021

(54) SUB-ATMOSPHERIC PRESSURE LASER IONIZATION SOURCE USING AN ION FUNNEL

(71) Applicant: SCIENCE AND ENGINEERING SERVICES, LLC, Columbia, MD (US)

(72) Inventors: Vladimir M. Doroshenko, Sykesville, MD (US); Victor V. Laiko, Columbia, MD (US); Eugene Moskovets, Columbia, MD (US)

(73) Assignee: SCIENCE AND ENGINEERING SERVICES, LLC, Columbia, MD (US)

( * ) Notice: Subject to any disclaimer, the term of this patent is extended or adjusted under 35 U.S.C. 154(b) by 0 days.

(21) Appl. No.: 16/122,527

(22) Filed: Sep. 5, 2018

(65) Prior Publication Data

US 2019/0074170 A1 Mar. 7, 2019

Related U.S. Application Data

(63) Continuation of application No. 15/261,383, filed on Sep. 9, 2016, now abandoned.

(51) Int. Cl.

| | |
|---|---|
| ***H01J 49/06*** | (2006.01) |
| ***H01J 49/16*** | (2006.01) |
| ***H01J 49/24*** | (2006.01) |

(52) U.S. Cl.

CPC ..... *H01J 49/164* (2013.01); *H01J 49/066* (2013.01); *H01J 49/24* (2013.01)

(58) Field of Classification Search

CPC ..... H01J 49/066; H01J 49/164; H01J 49/04; H01J 49/067; H01J 49/24

See application file for complete search history.

(56) References Cited

U.S. PATENT DOCUMENTS

| | | | | | |
|---|---|---|---|---|---|
| 5,965,884 | A * | 10/1999 | Laiko | H01J 49/164 | 250/288 |
| 6,057,543 | A * | 5/2000 | Vestal | H01J 49/164 | 250/282 |
| 6,107,628 | A * | 8/2000 | Smith | H01J 49/066 | 250/292 |

(Continued)

*Primary Examiner* — Wyatt A Stoffa

(74) *Attorney, Agent, or Firm* — Oblon, McClelland, Maier & Neustadt, L.L.P.

(57) ABSTRACT

A system and method for sample analysis using sub-atmospheric pressure (sub-AP) laser ionization. The sub-AP ion source includes a holder with a sample containing analyte molecules, a pulsed laser beam configured to generate ionized species from the sample, an ion extractor adjacent to the holder configured to extract analyte ions from the ionized species by an extraction electric field $E_s$ near the sample, an ion funnel structure composed of orifice electrodes located along an ion funnel pathway direction z. The ion funnel structure has an entrance and an exit, the exit being the electrode with the smallest aperture in the structure. This structure is configured for accepting the analyte ions from the ion extractor at the entrance and dragging them toward the exit using an axial electric field $E_z$ along the direction z. The extraction electric field $E_s$ is at least partly electrically shielded from the axial electric field $E_z$.

36 Claims, 8 Drawing Sheets

(56) References Cited

U.S. PATENT DOCUMENTS 6,967,325 B2 * 11/2005 Smith ..... G01N 27/622 250/288
7,495,212 B2 * 2/2009 Kim ..... H01J 49/066 250/292
8,188,424 B2 * 5/2012 Baykut ..... G01N 27/622 250/287
9,543,138 B2 * 1/2017 Vestal ..... H01J 49/403
10,062,558 B2 * 8/2018 Yasuno ..... H01J 49/10
10,109,471 B1 * 10/2018 Berkout ..... H01J 49/26
2002/0166961 A1 * 11/2002 Berggren ..... H01J 49/167 250/288
2003/0136905 A1 * 7/2003 Franzen ..... H01J 49/062 250/292
2003/0197121 A1 * 10/2003 Turecek ..... H01J 49/0086 250/281
2005/0092918 A1 * 5/2005 Smith ..... G01N 27/622 250/288
2005/0194544 A1 * 9/2005 Vestal ..... H01J 49/061 250/425
2006/0108520 A1 * 5/2006 Park ..... H01J 49/107 250/287
2006/0108539 A1 * 5/2006 Franzen ..... H01J 49/0404 250/423 P
2006/0284076 A1 * 12/2006 Scheidemann ..... H01J 49/066 250/288
2008/0042055 A1 * 2/2008 Baykut ..... G01N 27/622 250/287
2008/0185513 A1 * 8/2008 Belov ..... H01J 49/0031 250/288
2008/0272286 A1 * 11/2008 Vestal ..... B08B 1/00 250/282
2009/0039283 A1 * 2/2009 Franzen ..... H01J 49/0481 250/425
2009/0242755 A1 * 10/2009 Tang ..... H01J 49/066 250/288
2009/0294662 A1 * 12/2009 Belov ..... H01J 49/4235 250/291
2009/0302209 A1 * 12/2009 Green ..... H01J 49/0031 250/282
2010/0090102 A1 * 4/2010 Rather ..... G01N 27/622 250/283
2011/0036978 A1 * 2/2011 Franzen ..... H01J 49/0422 250/283
2011/0121170 A1 * 5/2011 Park ..... H01J 49/066 250/282
2011/0139977 A1 * 6/2011 Haase ..... H01J 49/164 250/282
2011/0198494 A1 * 8/2011 Huq ..... H01J 49/0013 250/282
2012/0241642 A1 * 9/2012 Hieke ..... H01J 49/164 250/424
2012/0298853 A1 * 11/2012 Kurulugama ..... H01J 49/044 250/282
2013/0207000 A1 * 8/2013 Gunther ..... H01J 27/024 250/396 R
2015/0357173 A1 * 12/2015 Koeppen ..... H01J 49/0463 250/282
2015/0380229 A1 * 12/2015 Harada ..... H01J 49/40 250/288
2016/0005578 A1 * 1/2016 Koeppen ..... H01J 49/0031 250/282
2016/0035556 A1 * 2/2016 Berkout ..... H01J 49/068 250/288
2016/0071716 A1 * 3/2016 Brown ..... H01J 49/065 250/423 P
2019/0198304 A1 * 6/2019 Ikegami ..... H01J 49/164
2020/0258732 A1 * 8/2020 Boock ..... H01J 49/0031

* cited by examiner

PRIOR ART

SUB-ATMOSPHERIC PRESSURE LASER IONIZATION SOURCE USING AN ION FUNNEL

CROSS-REFERENCE TO RELATED APPLICATIONS

This application is a continuation of U.S. application Ser. No. 15/261,383, filed Sep. 9, 2016, and the entire contents of which are incorporated herein by reference.

BACKGROUND OF THE INVENTION

Field of Invention

This invention is related to mass spectrometry of biological samples. More specifically, this invention is related to the operation of matrix-assisted laser desorption/ionization source at sub-atmospheric pressure in mass spectrometry imaging applications.

Description of the Related Art

Matrix-assisted laser desorption/ionization (MALDI) mass spectrometry (MS) is a standard technique for producing ions in vacuum from labile molecules especially those of biological origin such as proteins, peptides, and lipids. In addition MALDI is used to ionize polymer molecules and small organic molecules. In contrast to vacuum MALDI, ions in atmospheric pressure (AP—also sometimes referred to as ambient pressure) MALDI MS sources are produced at ambient pressure (see Laiko et al., U.S. Pat. No. 5,965,884; and Bai et al., U.S. Pat. No. 6,849,847—the entire contents of this and following cited publications are incorporated by reference). AP MALDI MS is widely used with a variety of different MS-based bio-analytical applications. Typically, the definition of the ambient pressure includes the pressure range from 0.1 Torr to 760 Torr (which here we also refer to as sub-atmospheric pressure or sub-AP) but MALDI at the atmospheric pressure (about 760 Torr) is mostly used in practice due to easiness of sample handling at the atmospheric pressure conditions. Small molecules can be ionized without a matrix (so-called direct laser ionization or DLI) and also using nanostructure-assisted laser desorption/ionization (NALDI), surface-enhanced laser/desorption ionization (SELDI), surface-assisted laser/desorption ionization (SALDI), or desorption/ionization on silicon (DIOS) techniques.

In addition to AP-MALDI, there are other AP ion sources utilizing different ionization techniques, which include electrospray ionization (ESI), AP chemical ionization (APCI), direct analysis in real time (DART), AP photoionization (APPI), desorption ESI (DESI), secondary ESI (s-ESI) etc. The AP ion sources are widely used with mass spectrometers having atmospheric pressure interface (API) for introduction of ions generated at atmospheric pressure conditions into the vacuum of mass spectrometers. The interchangeability of AP sources meaning that different AP sources can be attached to the same mass spectrometer typically within minutes, and the wealth of ionization techniques available at AP conditions, makes the mass spectrometers with API very popular nowadays. The AP ion sources are also used in ion mobility spectrometry (IMS) separating ions based on different gas phase mobility of ions while they are drifting in electric fields. IMS can also be operated in a wide pressure range from parts of Torr to 1 atm that makes them perfectly suitable for sub-AP MALDI.

Compared to AP MALDI the use of sub-AP MALDI at pressures below 1 atm is less common although even the first experiments at a few Torr pressure (see A. Verentchikov, I. Smirnov, M. Vestal, *Collisional Cooling and Ion Formation Processes in Orthogonal MALDI at Intermediate Gas Pressure*. In: Proc. 47-th ASMS Conf. Mass Spectrometry and Allied Topics, Dallas, Tex., 1999) showed its clear benefits in sensitivity by more than an order of the magnitude. Initially, a wide use of sub-AP MALDI was mostly constrained by a problem of control of ions at ambient pressures before they enter mass spectrometer for the analysis. The situation changed with the invention of an ion funnel device (see R. D. Smith, S. A. Shaffer, U.S. Pat. No. 6,107,628) which allowed the ion guiding and focusing at pressures up to about 30 Torr (see also R. T. Kelly, A. V. Tolmachev, J. S. Page, K. Tang, R. D. Smith, Mass Spectrometry Reviews, 2010, v. 29, 294-312). Sub-AP MALDI became popular with a wide spread of MS imaging (MSI) applications. In MSI experiments, a laser spot scans each pixel of the MSI image of a biological tissue sample. In MSI with high spatial resolution, the tightly focused laser spot is used (down to 1 μm in diameter) so the problem of sensitivity arises due to a small sample amount contained in a very small laser spot. Thus, due to a high sensitivity of sub-AP MALDI compared to AP MALDI its use in MSI experiments is desirable as it can facilitate the solution of the problem of MS imaging with high spatial resolution.

The interface of MALDI to an ion funnel was originally described by C. M. Whitehouse in U.S. Pat. No. 6,707,037. In the '037 design a MALDI sample was placed inside the funnel or close to the ion funnel entrance and the produced ions were directed to the ion funnel using the assistance of a gas flow. Current successful prior art utilizes an electric field between the sample holder and the funnel entrance to drive MALDI ions into the funnel. Still the MALDI sample is located at or close to the ion funnel entrance (see FIG. 1 adapted from E. W. Robinson, T. L. Fillmore, R. K. Chu, G. W. Slysz, F. E. Leach, G. Anderson, L. Paša-Tolić, *Incorporation of a dual ESI/MLDI source with a high resolution quadrupole-orthogonal time-of-flight (Q-OTOF) mass spectrometer for MS imaging applications*. In: Proc. 60-th ASMS Conf. Mass Spectrometry and Allied Topics, Vancouver, BC, Canada, 2012). As shown by the inventors below, the above designs do not provide optimal conditions for generation and transportation of ions toward a mass analyzer which is the main goal of this invention.

SUMMARY OF THE INVENTION

In one embodiment of the present invention, there is provided an apparatus for sample analysis having a laser ionization source operated at sub-atmospheric pressure conditions. The apparatus includes a holder including a sample containing analyte molecules, a laser beam configured to generate ionized species from the sample, an ion extractor adjacent to the holder and configured to extract analyte ions from the ionized species by an extraction electric field $E_s$ near the sample, and an ion funnel structure external to the sample holder and ion extractor comprising orifice electrodes located along an ion funnel pathway direction z; said structure having an entrance with a size D and an exit, the exit being the electrode with the smallest aperture in the structure. The ion funnel structure is configured to accept the analyte ions from the ion extractor at the entrance and drag the analyte ions toward the exit using an axial electric field $E_z$ along the direction z wherein the extraction electric field $E_s$ is at least partly electrically shielded from the axial electric field $E_z$. In one variation of the above embodiment, the analyte ions are produced by MALDI and the extraction electric field $E_s$ is at or greater than an electric field threshold for extraction of said analyte ions from the ionized species or, preferably, at least twice greater than an electric field threshold for extraction of said analyte ions from the ionized species.

In another embodiment of the present invention, there is provided a method for sample analysis utilizing a laser ionization source operated at sub-atmospheric pressure conditions. The method includes placing a sample containing analyte molecules on a holder, generating ionized species from the sample using a laser ionization technique, extracting analyte ions from the ionized species by an extraction electric field $E_s$ near the sample, directing the extracted analyte ions into the ion funnel structure described above, and dragging the extracted analyte ions from the entrance to the exit of the ion funnel structure by an axial electric field $E_z$ along the direction z, wherein said extraction electric field $E_s$ is at least partly electrically shielded from the axial electric field $E_z$. In a variation of the above method, the analyte ions are produced by MALDI, and the extraction electric field $E_s$ is at or greater than an electric field threshold for extraction of said analyte ions from the ionized species or, preferably, at least twice greater than an electric field threshold for extraction of said analyte ions from the ionized species.

It is to be understood that both the foregoing general description of the invention and the following detailed description are exemplary, but are not restrictive of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Having small laser spots (less than 1-5 μm) is highly desirable in MSI experiments. Thus, prior to the present invention, there was a need to resolve the sensitivity problem in high spatial resolution MSI which is due to a tiny amount of a sample in the pixel involved. The present inventors have found and reported that the design of E. W. Robinson et al. was ineffective [V. Doroshenko, V. Laiko, E. Moskovets, *A comparison of performance characteristics of AP and low-pressure (SubAP) MALDI sources*. In: Proc. 64-th ASMS Conf. Mass Spectrometry and Allied Topics, San Antonio, Tex., 2016]. Accordingly, this invention is related to sub-AP MALDI ion sources having higher ion yield production and which can facilitate a solution of this sensitivity problem.

Ion funnel for the purpose of this invention is typically a simple structure of electrodes with apertures allocated along the same axis and having the largest aperture electrode at one end and the smallest aperture electrode at the second end (an exit) with the aperture sizes typically decreasing from the first end to the second end. In one embodiment of the invention, the electrodes can be made of metal or metal-clad printed circuit boards (PCB). PCBs are convenient in production, and in addition one PCB can contain multiple "electrodes" made as metal strips on a PCB surface [see, for example, Anderson et al. U.S. Pat. No. 8,835,839 (the entire contents of which are incorporated herein by reference)]. RF and DC potentials are applied to the electrodes to facilitate ion transfer toward the second end.

In one embodiment of the invention, ion funnels can be attached to each other (not necessarily along a single axis). In one embodiment of the invention, ion funnels can be can be located at the same pressure and are referred to here as adjacent ion funnels composing a large ion funnel structure.

In one embodiment of the invention, an ion funnel structure may have one or more funnels located in different vacuum sections at different pressures which in this case are considered as different ion funnel stages of the total ion funnel structure.

Sub-atmospheric pressure means any pressure below 1 atm and in one embodiment down to about 0.5 Torr, while in other embodiments down to about 0.1 Torr, while in other embodiments down to about 0.01 Torr.

Figure 2:
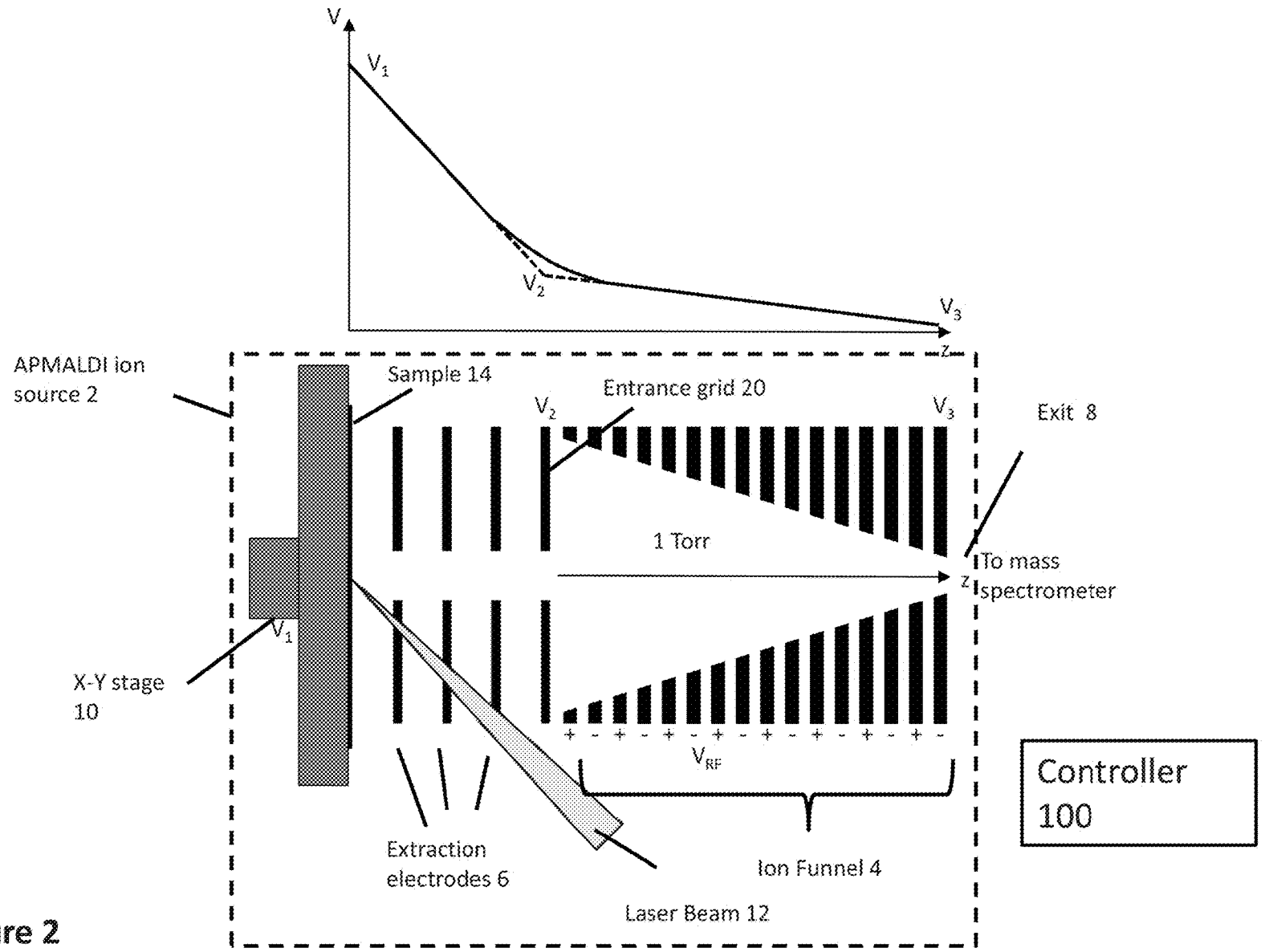
FIG. 2 is a schematic according to one embodiment of the invention showing a sub-AP MALDI ion source interfaced to an ion funnel by a stack of electrostatic extraction electrodes.

FIG. 2 is a schematic according to one embodiment of the invention showing a sub-atmospheric pressure matrix assisted laser desorption/ionization (AP MALDI) ion source 2 interfaced to an ion funnel 4 using a stack of electrostatic extraction electrodes 6. In one embodiment of the AP MALDI ion source 2, a two-stage potential distribution along the ion pathway inside the ion source structure exists, as shown at the top of FIG. 2.

In one embodiment of the AP MALDI ion source 2, the ion funnel 4 is a structure composed of stacked electrodes with apertures (or openings). The purpose of an ion funnel 4 is typically to facilitate interfacing AP ionization sources with a mass analyzer located at the vacuum. An ion funnel 4 guides ions and concentrates the ions along its way to an exit 8 of the funnel 4 which also serves as a conductance limit between two differentially-pumped regions. The ion funnel 4 is located in one of those differentially-pumped regions while the other is usually a home of various ion optics, mass analyzer, and ion detector. Thus, the ion funnel 4 typically has a smallest aperture electrode at its exit 8. In one embodiment, the entrance of ions into the funnel structure is typically at the other end of the funnel, but in other embodiments the entrance can be also at the side wall opening to avoid direct line access to the funnel exit for foreign particles (like dust or aerosols) entering the funnel with the ambient air.

Typically the electrode apertures in ion funnel 4 decrease in size from the entrance to the exit 8, but this condition is not rigid and the electrode apertures in ion funnel 4 may be sized differently if for example the ion funnel 4 has other functions like trapping ions before ejecting them for the analysis. Thus, in one embodiment, the shape and size of apertures in an ion funnel 4 may vary if the ion funnel 4 serves functions other than simple guiding and concentration along ion pathway.

To trap ions in radial direction, time-varying electric voltage is applied to the funnel electrodes—typically radio-frequency (RF) voltages of opposite polarity are applied to neighboring electrodes. In one embodiment of the invention, a controller 100 is programmed to control radio-frequency (RF) voltages of opposite polarity applied to neighboring electrodes of ion funnel 4. The theory of funnel operation is rather complicated as it involves a formation of residual pseudo-potential created by the RF electric field, axial DC electric field (see below), space charge effect, and gas dynamic drag of the ions caused by air flow through the funnel to its exit. For these reasons the ion funnel operation was optimized mostly experimentally. Typical ion funnel design includes thin (0.5-1 mm thick) metal plates separated by a distance equal to the plate thickness and having round apertures ranging from 25-50 mm diameter at the entrance and gradually decreasing to a diameter ranging from 1.5-2 mm at the exit 8. An optimal aperture divergence angle from the entrance to the exit is typically about 30° (full angle). The RF voltage applied to the electrodes is typically 100-150V (peak-to-peak) at 700-2000 kHz frequency depending on the pressure and ion mass. Typical pressures achieved in the ion funnels can be varied over the range of 0.5-30 Torr. Finally, an axial DC electric field is created in the internal space of the funnel 4 for dragging the ions from the funnel entrance toward the exit 8. The optimal axial field for the aperture divergence angle of 30° is about 10-15 V/cm. Higher axial fields can result in ion losses on the funnel walls, especially for low mass ions. As it was found in experiments, this optimal axial field does not depend greatly on the pressure inside the ion funnel 4.

When a MALDI source is interfaced to an ion funnel, a number of requirements are preferably met. First, the ion funnel should operate at optimal conditions, namely, the pressure, RF voltage, frequency, and axial electric field should all be set for maximum ion transmittance. Secondly, MALDI ions should be generated and introduced into the funnel with a high efficiency (e.g., greater than 70% or greater than 80% or greater than 90%). Ion funnel operational conditions are known. Accordingly, the disclosure here focusses on a description of the MALDI ions and how the MALDI ions are introduced into the ion funnel 4.

In one embodiment of the invention, a MALDI sample 14 is located for example on a stainless steel plate fixed atop one or more X-Y stages 10 to control the position of a spot from a laser beam 12 focused on the sample. For details on the sample preparation and experimental setup, see: V. Doroshenko, V. Laiko, E. Moskovets, *A comparison of performance characteristics of AP and low-pressure (SubAP) MALDI sources*, In: Proc. 64-th ASMS Conf. Mass Spectrometry and Allied Topics, San Antonio, Tex., 2016. In one embodiment of the invention, a stack of electrostatic extraction electrodes 6 in front of the funnel 4 permits a change to the extracting electric field near the sample plate independently of the axial field inside the ion funnel 4. The results of experiments by the inventors are shown in FIG. 3 where the dependences of intensities of MALDI-generated ions having different masses upon the electric field extracting the ions from the sample are shown.

Figure 3:
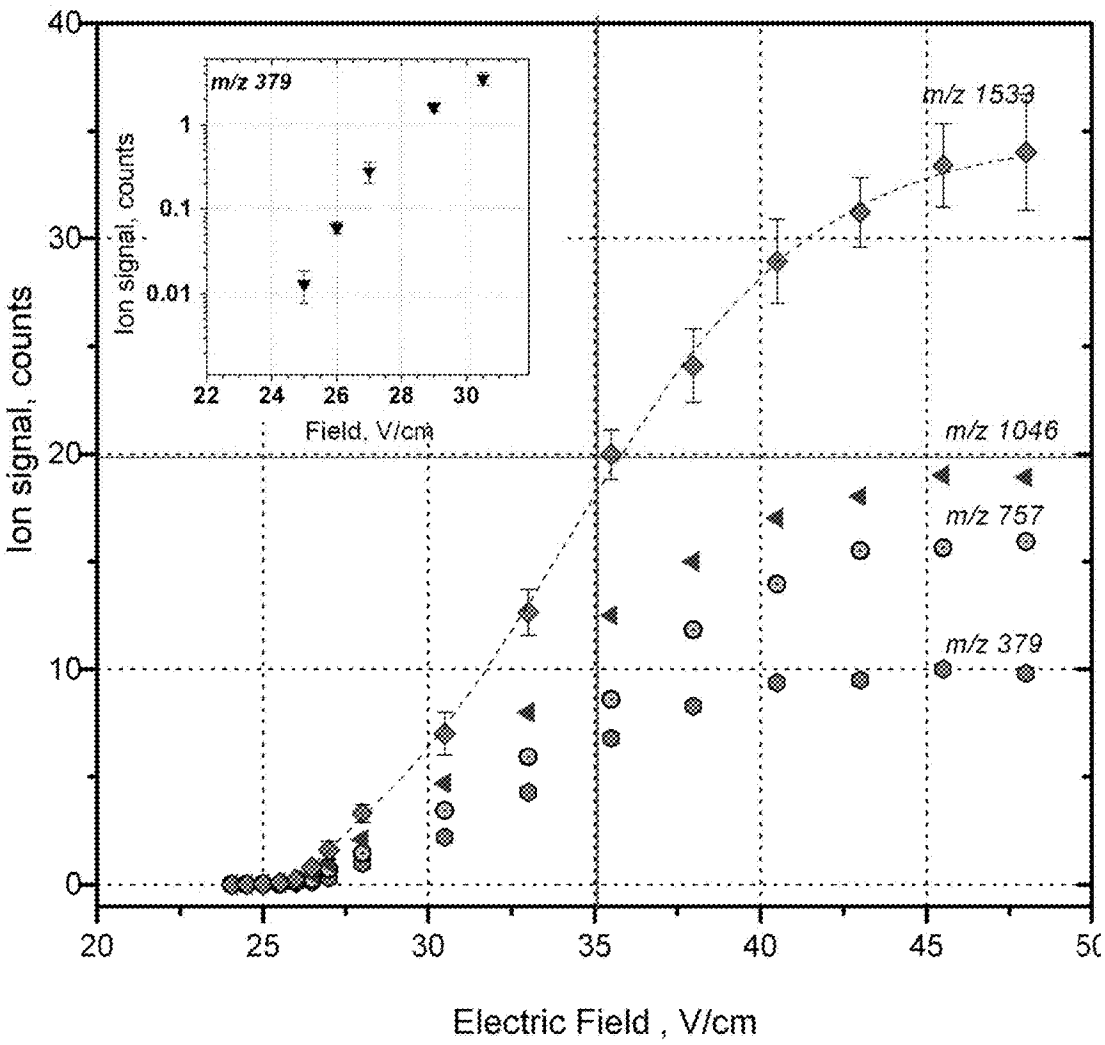
FIG. 3 is a schematic plot showing the dependence of MALDI ion signals of different masses on the extraction electric field strength near the sample holder at the pressure of 1 Torr.

Two important inventive features are evident from the data in FIG. 3. Firstly, there is a threshold for the extracting electric field below which no ions are generated from the sample at all (about 25 V/cm at the conditions of the experiment of FIG. 3 as shown in more detail on the inset for m/z 379 ions). Secondly, above the threshold, the number of ions extracted from the sample rapidly increases reaching a plateau at 40-50 V/cm (depending on ion mass). The first observation is unique to sub-AP MALDI (no such phenomenon has been observed before in either AP or vacuum MALDI experiments).

While the exact reason of this behavior is not presently known for certain, in one embodiment of the invention, it may be considered that, in a sub-AP MALDI source, both positive and negative ionized species are initially generated such as adducts with surrounding matrix molecules. Accordingly, some electric field is required to 1) separate positive and negative ionized species before they recombine with each other, and 2) accelerate and heat them in collisions with air molecules so that the positive and negative ionized species can break apart with the formation of analyte ions.

Similar adducts can be formed in vacuum MALDI but in the absence of collisions these adducts could be dissociated only by applying more laser energy for sample ablation. In the case of AP MALDI, the adducts are quickly thermalized in collisions with dense air molecules so the analyte molecules are generated mostly in a heated inlet capillary on the way to a mass spectrometer. The ion yield increase with a higher electric field near the sample can be explained by a charge separation mechanism similar to that observed in AP MALDI in V. D. Berkout, S. I. Kryuchkov, V. M. Doroshenko, *Modeling of Ion Processes in Atmospheric Pressure Matrix-Assisted Laser Desorption/Ionization*, Rapid Commun. Mass Spectrom., 2007, v. 21, 2046-2050.]. Yet, the phenomenon of the electric field threshold in extracting of ions from a sample itself is unique to sub-AP MALDI.

The above discovery led the inventors to refine the extracting electric field in sub-AP MALDI sources of the present invention. First, it became evident that in a typical Sub-AP MALDI/ion funnel setup the ion extraction field is usually greater (and typically much greater) than the ion funnel axial field. Thus, the corresponding extraction voltage is also to be large. Applying high electric fields at e.g., 1 Torr pressure can be complicated by a glow discharge phenomena (a maximum voltage applied to the MALDI plate in the above experiment was at 400 V level in this example). Moreover, the present inventors have found that it is even more important that the large electric extraction field required for efficient production of ions in sub-AP MALDI be greater than the optimal axial electric field used in a typical ion funnel device (which is about 10-15 V/cm). All these led the inventers to their conception of independent control of the extraction and axial electric fields. To separately control the extraction and axial fields in present invention when the extraction and axial fields substantially differ in their respective values, the areas of these electric fields should be at least partly shielded from each other as it will be described below. Thus, in one embodiment of the invention, an ion extractor generating electric field near the sample is controlled independently from a controller generating an axial electric field inside a funnel. In one embodiment of the invention, the extraction electric field should be at least twice the axial field inside the funnel or at least twice the optimal axial field inside the funnel. In another embodiment of the invention, the extraction electric field $E_s$ is set to be at or greater than a threshold electric field for extraction of analyte ions from the ionized species generated by the laser beam and, preferably, be at least twice greater than the threshold electric field for extraction of analyte ions.

Figure 1:
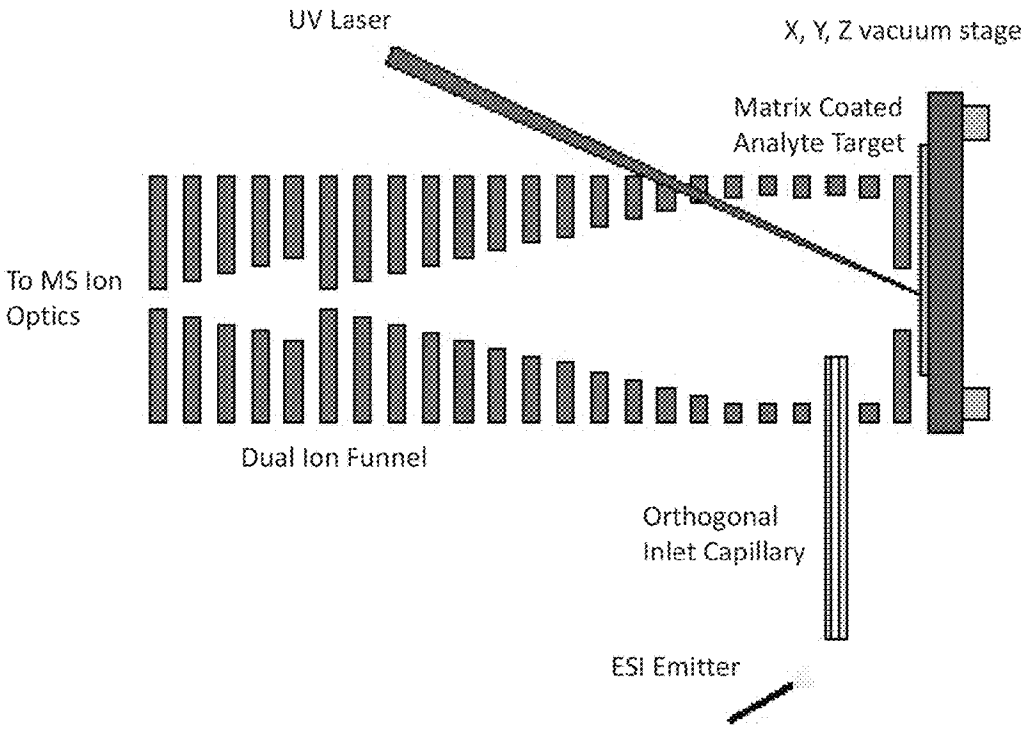
FIG. 1 shows a prior art scheme of the Sub-AP MALDI source interfaced to an ion funnel.

This condition was not a part of any previous sub-AP MALDI designs where a MALDI plate was actually a part of an ion funnel wall and fully open to the ion funnel volume, and indeed the independent control of the extraction and axial electric fields would not have been possible in any of the previous sub-AP MALDI designs that the inventors were aware of at the time of this invention. For instance, in the prior art (FIG. 1), the electric field near the sample could not be very different from the electric field inside the funnel. Thus, if the electric field near the sample plate is strong then the electric field inside the ion funnel is far from optimal, or vice versa, if the electric field inside the ion funnel is optimal then the electric field near the plate is too small for effective generation of MALDI ions. For this reason, in one embodiment of the invention, there is a physical separation of ion extraction and ion funnel regions so the conditions for ion generation by MALDI and ion guidance inside an ion funnel can be changed (e.g., optimized) separately. To make independent control, the electric fields in the ion extractor and ion funnel are at least partly electrically shielded from each other. Because, in principle, the axial electric field inside an ion funnel $E_z$ can be slightly non-uniform, it is acceptable to use an average $<E_z>$ of this field along the ion pathway inside the ion funnel for description of the axial field inside the funnel. Typically, to avoid losses of ions, all possible deviations of the axial field from $<E_z>$ should not be very large. If it is so, the average field $<E_z>$ realistically describes the processes of the ion drag by the axial electric field.

In one embodiment of the invention, the extraction electrodes 6 (particularly the extraction electrode closest to the sample 14) provides the requisite structure for an ion extractor extracting analyte ions from the ionized species by an extraction electric field $E_s$ near the sample. In one embodiment of the invention, the optimal extraction field in the sub-AP MALDI of the invention is actually proportional to the pressure inside the ion source (up to the atmospheric pressure of 760 Torr when the optimal extraction field is about 25 kV/cm). Keeping in mind that the optimal axial field inside the ion funnel is largely not dependent on the pressure inside the funnel, at pressures higher than 1 Torr, in one embodiment of the invention, the extraction field in sub-AP MALDI at pressures higher than 1 Torr compared to the axial electric field in a funnel should be much higher than two times. In one embodiment of the invention, the extraction field in sub-AP MALDI at pressures higher than 1 Torr compared to the axial electric field in a funnel should be 2*p higher, where p is the pressure in Torr units.

In one embodiment of the invention, as schematically shown in FIG. 2, an ion extraction region is separated from an ion funnel. This permits independent control of the extraction voltage near the MALDI plate (at sample 14) and independent control of the axial electric field inside the funnel. As a result, the electric field inside the funnel can be set at about optimal 10-15 V/cm while the extraction field (at sample 14) can be established above 40/p V/(Torr·cm). The ion extraction and delivery to the entrance of the ion funnel in the design shown in FIG. 2 is achieved using a stack of electrostatic electrodes (lenses) 6. In one embodiment of the invention, the connection of the stack to the ion funnel 4 entrance can be made via entrance grid 52 (see FIG. 6), for example a metal wire grid with high transmittance for the ions (which should completely decouple the fields inside the stack and the funnel) or in a gridless manner (as in FIGS. 2, 4, 5). A grid provides one example of a full (100%) electrical shielding of the extraction region from the ion funnel region. For practical needs, it is not actually required to have a full shielding. In many cases, a partial shielding would be enough for successful operation. There may be a number of definitions of electric shielding efficiency. As used herein, electric shielding efficiency of a particular design is defined by comparing the extraction field $E_s$ near the sample in this design to that wherein a grid is present at the ion funnel entrance. For example, if the extraction field without the grid ($E_s$) is twice less than that with the grid ($E_{sg}$) then the shielding efficiency is $(E_{sg}-E_s)/E_{sg}=50\%$ (usually $E_s$ is always smaller than $E_{sg}$). The shielding efficiency of 50% may be sufficient in some design, but designs with higher efficiency can also be built and are preferable. In one embodiment of the invention, the extraction electrode stack should be made long enough so that the field from the ion funnel 4 does not penetrate the area near the MALDI plate (through a so-called "sagging" phenomenon as shown in the electric potential distribution at the top in FIG. 2). To achieve the effective electric isolation/shielding of the extraction and axial electric fields in the gridless scheme, the length of an ion extractor (or a stack of extraction electrodes) should be at least greater than the diameter of the entrance to the ion funnel.

In one embodiment of the invention, the controller 100) is programmed to control independently an axial electric field inside the ion funnel structure $E_z$ and the extraction electric field $E_s$. In one embodiment of the invention, the controller 100 is programmed to control the extraction electric field $E_s$ to be at or greater than an electric field threshold for extraction of said analyte ions from the ionized species. In one embodiment of the invention, the controller 100 is programmed to control the extraction electric field $E_s$ to be at least twice greater than an electric field threshold for extraction of said analyte ions from the ionized species. In one embodiment of the invention, the controller 100 is programmed to control an average axial electric field from the entrance to the exit inside the ion funnel structure $<E_z>$ to be at least twice smaller than the extraction electric field $E_s$.

PREFERRED EMBODIMENTS

Exemplary and non-limiting embodiment a sub-AP MALDI ion source with an ion funnel according to this invention is described below.

The sub-AP MALDI design shown in FIG. 2 includes a two-stage ion funnel commercially available from MassTech, Inc. (the second stage is not shown in FIG. 2) and an X-Y stage with a sample holder that is mounted 20 mm away from the frontal section of the first (high-pressure) stage of two-stage ion funnel. Opposite to the sample holder is a 1-mm thick stainless steel plate covering the funnel throat with a hole at the center for ion entrance (an ion funnel entrance). To transmit the ions from the MALDI source into the funnel, a stack of three metal electrodes 6 with 5-mm diameter apertures placed equidistantly 5 mm apart between the MALDI plate and the ion funnel entrance hole 20 was used. After dividing equally the voltage difference between $V_1$ and $V_2$ applied to the MALDI plate and the funnel entrance plate using an external 100-kOhm resistor network, the corresponding voltages are applied to the stack electrodes 6 to generate a nearly uniform extracting electric field within the stack volume as shown at the top of FIG. 2.

Both stages of the ion funnel 4 are composed of 0.75-mm thick electrodes having round apertures and spacers between them, the electrodes being placed equidistantly 1.5 mm apart. The first stage is placed within a sub-AP MALDI source vacuum chamber. It is connected though the first stage funnel exit electrode having 2-mm diameter orifice to the second ion funnel stage which is located within a mass spectrometer vacuum chamber (LTQ, Thermo Fisher Scientific, San Jose, Calif.) not shown but referenced in FIG. 2. The air into the sub-AP MALDI source chamber is supplied by a leak valve (Model MIL-MV-11-10-303, Beswick Engineering, Greenland, N.H.) from atmosphere and, then, is pumped away through the first ion funnel 2-mm exit hole to the second funnel stage by the MS for vacuum pump to maintain a 1-3 Torr pressure level within the first ion funnel stage (ion source chamber) and 0.5-1 Torr within the second ion funnel stage.

Both the electrodes and spacers are made of 0.75-mm thick metalized boards using printed circuit board (PCB) technology. The length of the first ion funnel stage (ion funnel 4) interfaced to the MALDI source is about 56 mm with the largest electrode aperture of 25 mm diameter and the full aperture divergence angle toward the 2-mm aperture exit electrode of about 30°. All neighboring electrodes are connected to each other through a resistive (100 kOhm) network dividing equally the voltage difference between the entrance ($V_2$) and exit ($V_3$) electrodes to create a uniform axial electric field of about 12 V/cm inside the funnel to drag ions toward the funnel exit. In addition the RF voltages of opposite polarities (±150 $V_{p-p}$, 1100 kHz) are applied alternatively through separating capacitors (0.1 nF) to all electrodes of the funnel except the entrance and exit electrodes to create a trapping pseudopotential to keep ions away from the ion funnel walls (the entrance and exit electrodes are at DC potentials only). All RF and DC voltages ($V_1$, $V_2$, $V_3$) are generated using electronics provided with MassTech commercial ion funnel. A preferable distribution of DC potential along the ion pathway from the sub-AP MALDI ion source to the ion funnel exit is shown at the top of FIG. 2 (the electric field near the sample according to our invention should preferably be at least twice stronger than averaged of that inside the ion funnel).

A 355-nm laser (Model FTSS355-Q2, CryLaS GmbH, Berlin, Germany) provides a laser beam 12 which is delivered through an optical attenuator and a quartz window in the ion source vacuum chamber wall (not shown in FIG. 2) to the MALDI plate at a 60° incidence angle using a 50-mm focal length quartz lens focusing the beam into about 10-μm slightly elongated elliptical spot. The laser spot size could be increased up to about 50 μm by changing the lens distance to the MALDI plate (the lens is mounted on a 6-mm travel kinematic stage which can be controlled from outside without breaking the MALDI ion source vacuum—not shown in FIG. 2).

The laser spot dimensions and its position relatively the MS gas inlet can be displayed and seen on a computer monitor using a CCD camera located inside the sub-AP MALDI source vacuum chamber (not shown in FIG. 2). To get the best image quality, the sample is illuminated perpendicularly to the CCD camera vision line by a light-emitting diode (LED). This image is used for a precise adjustment of the laser beam spot size and its position on the sample.

Figure 4:
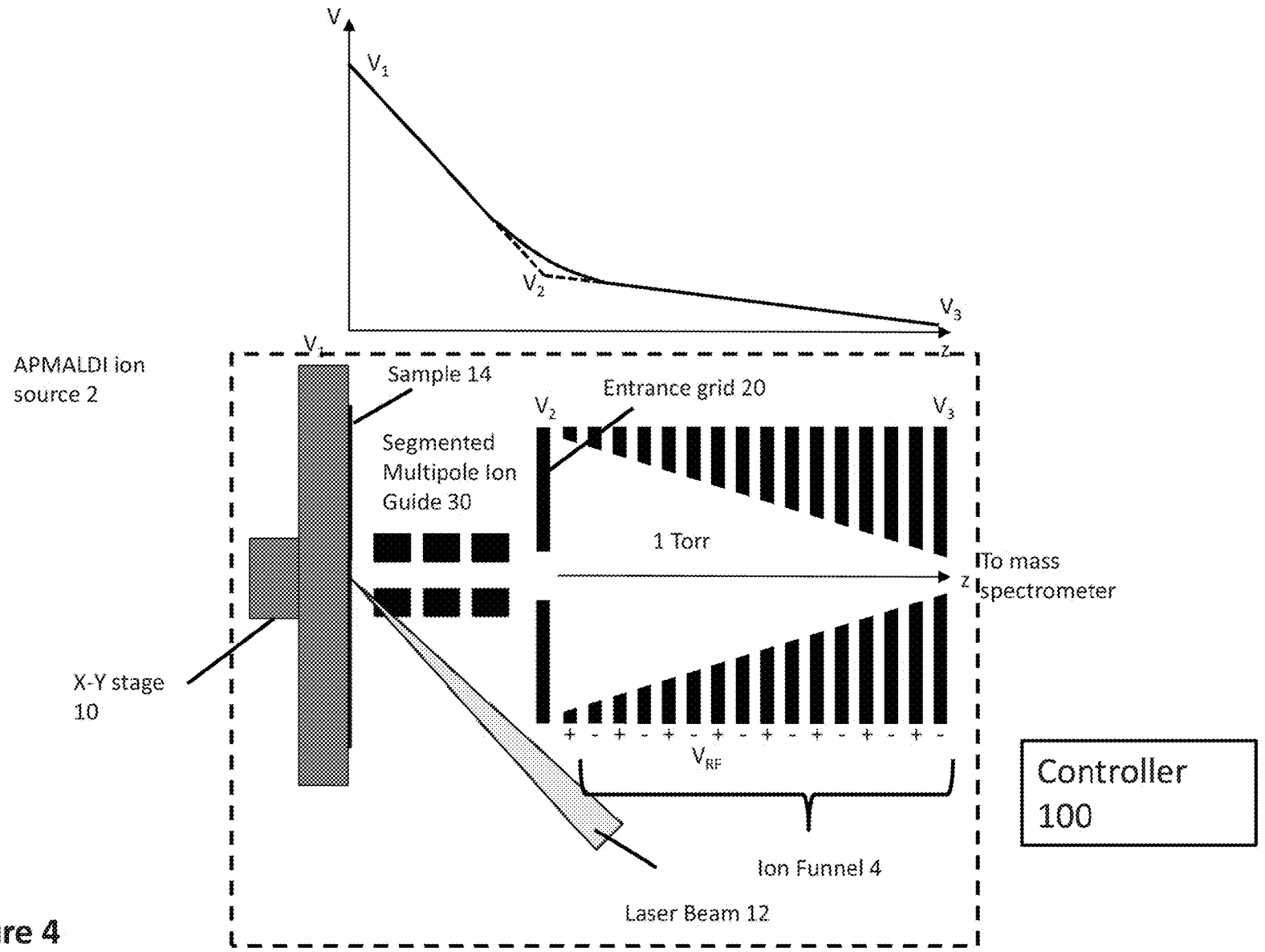
FIG. 4 is a schematic according to one embodiment of the invention showing a sub-AP MALDI ion source interfaced to an ion funnel by a segmented multipole ion guide.

In another embodiment of the invention, the stack of extracting electrodes 6 is replaced by a multipole ion guide 30 as shown in FIG. 4. To have a more uniform extracted field, in one embodiment of the invention, the multipole ion guide is segmented with a separate evenly-distributed extracting DC voltages applied to the ion guide segments. Each segment of the multipole ion guide is preferably constructed from four (quadrupole), six (hexapole), or eight (octopole) rods. In one embodiment of the invention, the rods of the multipole ion guide (particularly the segment closest to the sample 14) provides the requisite structure for an ion extractor extracting analyte ions from the ionized species by an extraction electric field $E_s$ near the sample. A desired distribution of DC potential along the ion pathway from the sub-AP MALDI ion source to the ion funnel exit is shown at the top of Figure of 4.

Figure 5:
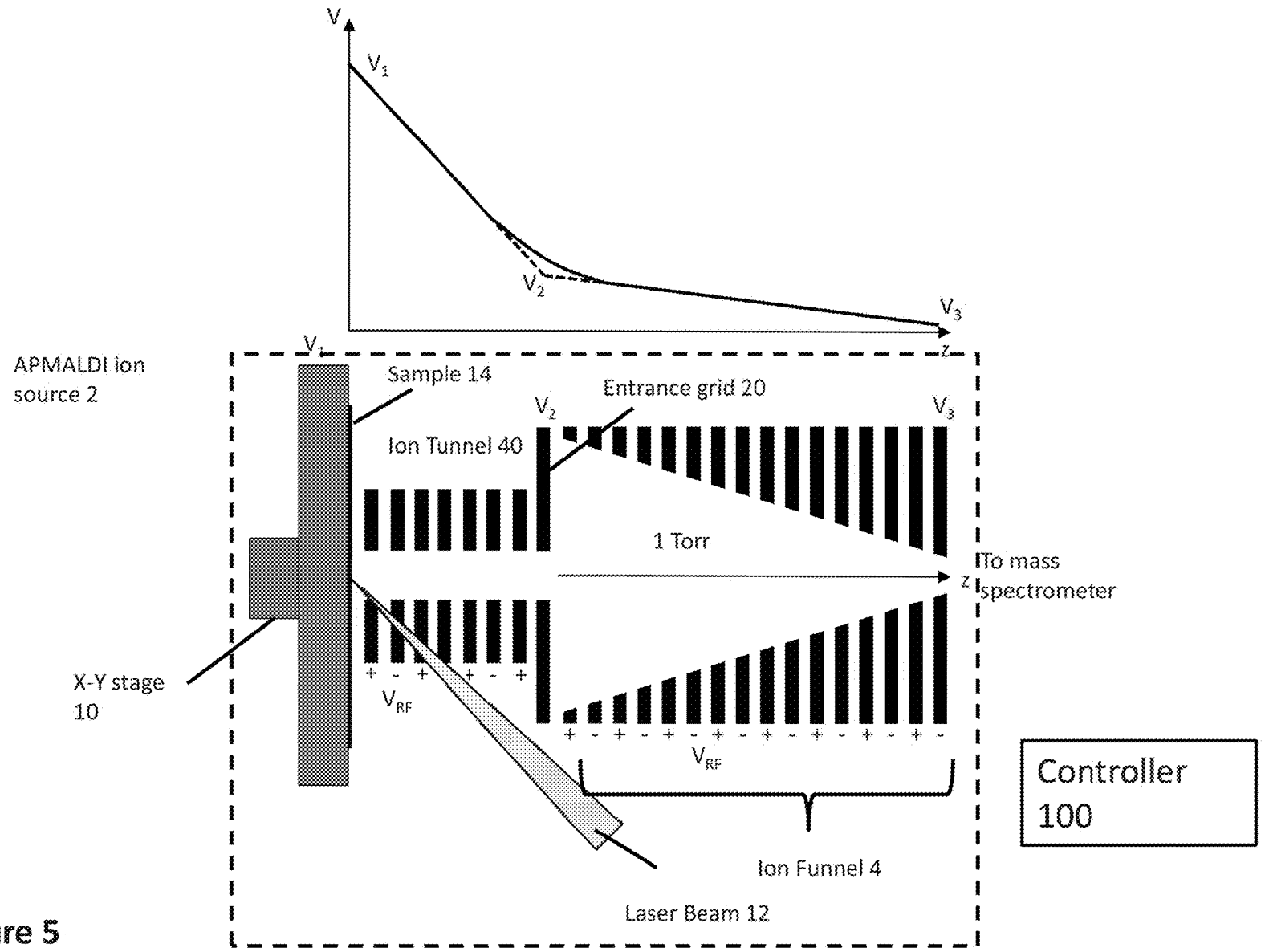
FIG. 5 is a schematic according to one embodiment of the invention showing a sub-AP MALDI ion source interfaced to an ion funnel by an ion tunnel structure.

In another embodiment of the invention, the stack of extracting electrodes 6 is replaced by an ion tunnel device 40 as shown in FIG. 5. The ion tunnel is similar to ion funnel 30, but typically has in general the same openings in its electrodes so compared to an ion funnel it mostly guides ions (but not concentrates, like an ion funnel). In one embodiment of the invention, the electrodes of the ion tunnel device 40 (particularly the electrode closest to the sample 14) provide the requisite structure for an ion extractor extracting analyte ions from the ionized species by an extraction electric field E, near the sample. The electrode openings in ion tunnel 40 typically are the same, but the openings may change (for example, increase) from the tunnel entrance to its exit.

Figure 6:
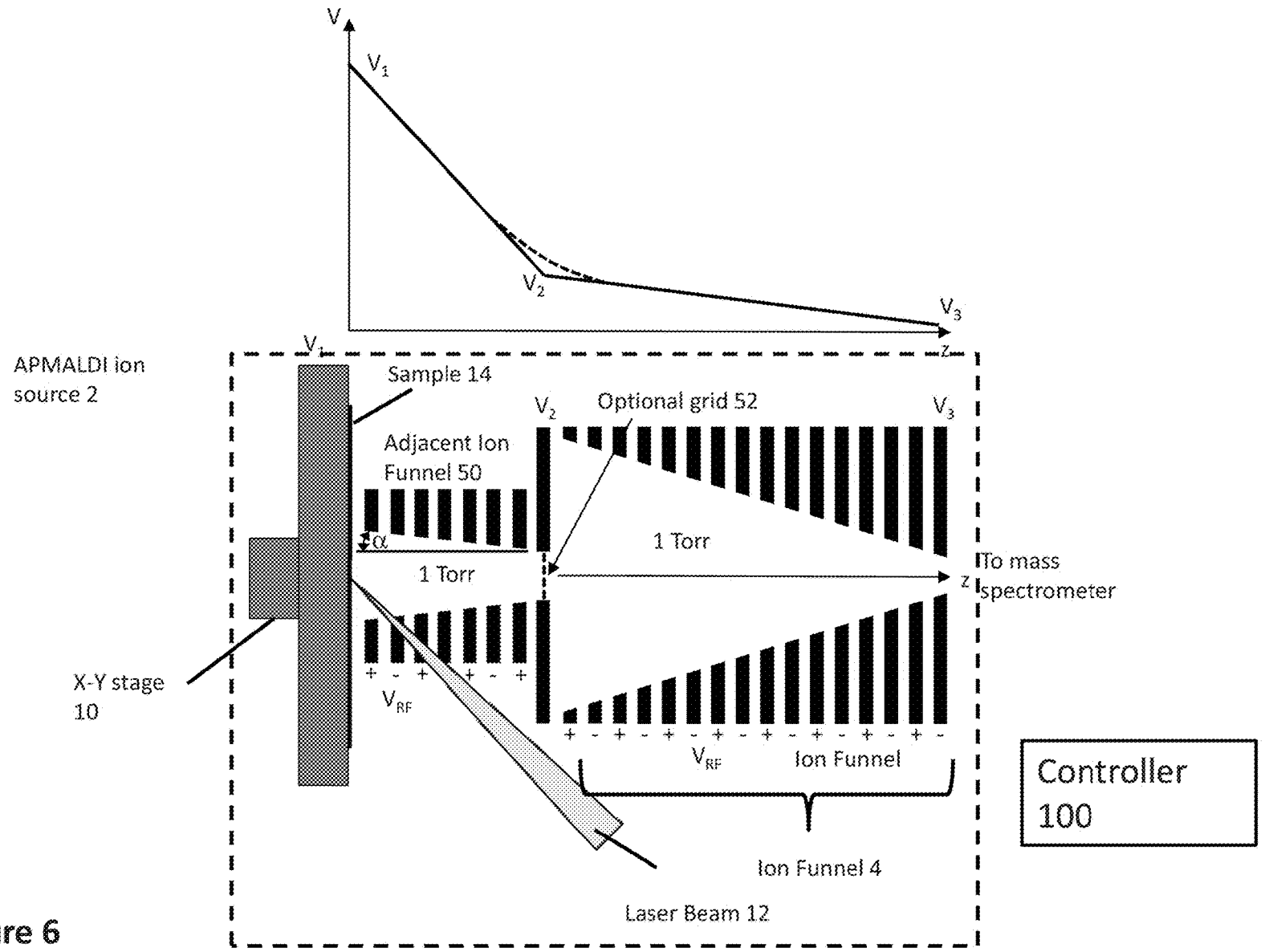
FIG. 6 is a schematic according to one embodiment of the invention showing a sub-AP MALDI ion source interfaced to an ion funnel by an adjacent ion funnel structure.

An additional adjacent ion funnel 50 (as shown in FIG. 6) can also be used instead of the ion tunnel 40, especially if it is designed for high dragging axial electric fields, i.e., if smaller than 30° aperture divergence angles are used (half-angle is shown as a in FIG. 6). In one embodiment of the invention, the electrodes of the ion funnel 50 (particularly the electrode closest to the sample 14) provide the requisite structure for an ion extractor extracting analyte ions from the ionized species by an extraction electric field $E_s$ near the sample.

An additional adjacent ion funnel 50 (as shown in FIG. 6) can also be used instead of the ion tunnel 40, especially if it is designed for high dragging axial electric fields, i.e., if smaller than 30° aperture divergence angles are used (half-angle is shown as α in FIG. 6). In one embodiment of the invention, the electrodes of the ion funnel 50 (particularly the electrode closest to the sample 14) provides the requisite structure for an ion extractor extracting analyte ions from the ionized species by an extraction electric field $E_s$ near the sample.

In one embodiment of the invention, an additional metal wire grid (a mesh) 52 with high ion transmittance (>60%) is placed at the ion funnel entrance to fully separate the extraction region of the ion extractor and the dragging region of the ion funnel structure. Distributions of DC potential along the ion pathway from the sub-AP MALDI ion source to the ion funnel exit are shown at the top of FIGS. 2 and 4-6.

Structures such as those discussed above electrically isolate and/or shield the extraction electric field from the electric field in ion funnel 4 directing ions toward an exit of the ionization source and preferably toward a mass spectrometer for analysis.

Figure 7:
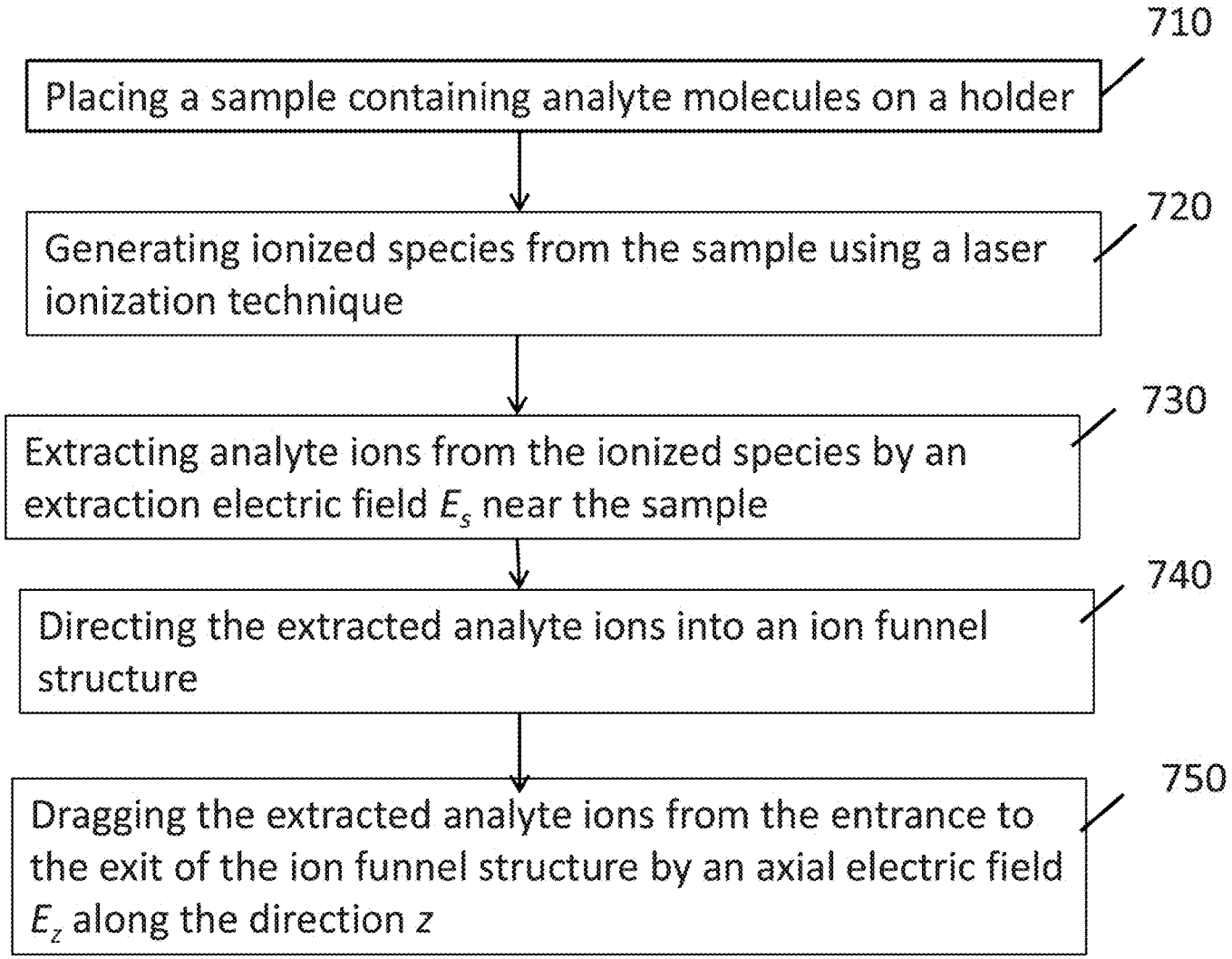
FIG. 7 is a flow chart depicting a method according to one embodiment of the invention.

FIG. 7 is a flow chart depicting a method according to one embodiment of the invention. This method provided is for sample analysis utilizing a laser ionization source operated at sub-atmospheric pressure conditions. The method includes at step 710 placing a sample containing analyte molecules on a holder, at step 720 generating ionized species from the sample using a laser ionization technique, at step 730 extracting analyte ions from the ionized species by an extraction electric field $E_s$ near the sample, at step 740 directing the extracted analyte ions into an ion funnel structure, and at step 750 dragging the extracted analyte ions from the entrance to the exit of the ion funnel structure by an axial electric field $E_z$ along the direction z. The axial electric field $E_z$ is electrically shielded from an axial electric field $E_s$ inside the ion funnel structure. Indeed, in one embodiment of the invention, as noted above, a controller 100 (such as shown in FIG. 2) is programmed to control independently an axial electric field inside the ion funnel structure $E_z$ and the extraction electric field $E_s$. In one embodiment of the invention, the controller 100 is programmed to control the extraction electric field $E_s$ to be at or greater than an electric field threshold for extraction of said analyte ions from the ionized species. In one embodiment of the invention, the controller 100 is programmed to control the extraction electric field $E_s$ to be at least twice greater than an electric field threshold for extraction of said analyte ions from the ionized species. In one embodiment of the invention, the controller 100 is programmed to control an average axial electric field from the entrance to the exit inside the structure $<E_z>$ to be at least twice smaller than the extraction electric field $E_s$.

Other designs and combinations thereof providing independent control of the ion extraction electric field near the sample and the dragging electric filed inside the ion funnel can also be envisioned. For example, the directions for ion extraction and dragging the ions in the ion funnel may not be along the same line. These directions can off-set, angled or even perpendicular when the ions are injected into the ion funnel through a small opening in the ion funnel wall. The recommended optimal dragging electric field $E_z$ in an ion funnel changes with pressure p inside the funnel (but the ratio $E_z/p$ preferably remains constant).

Computerized Control

Figure 8:
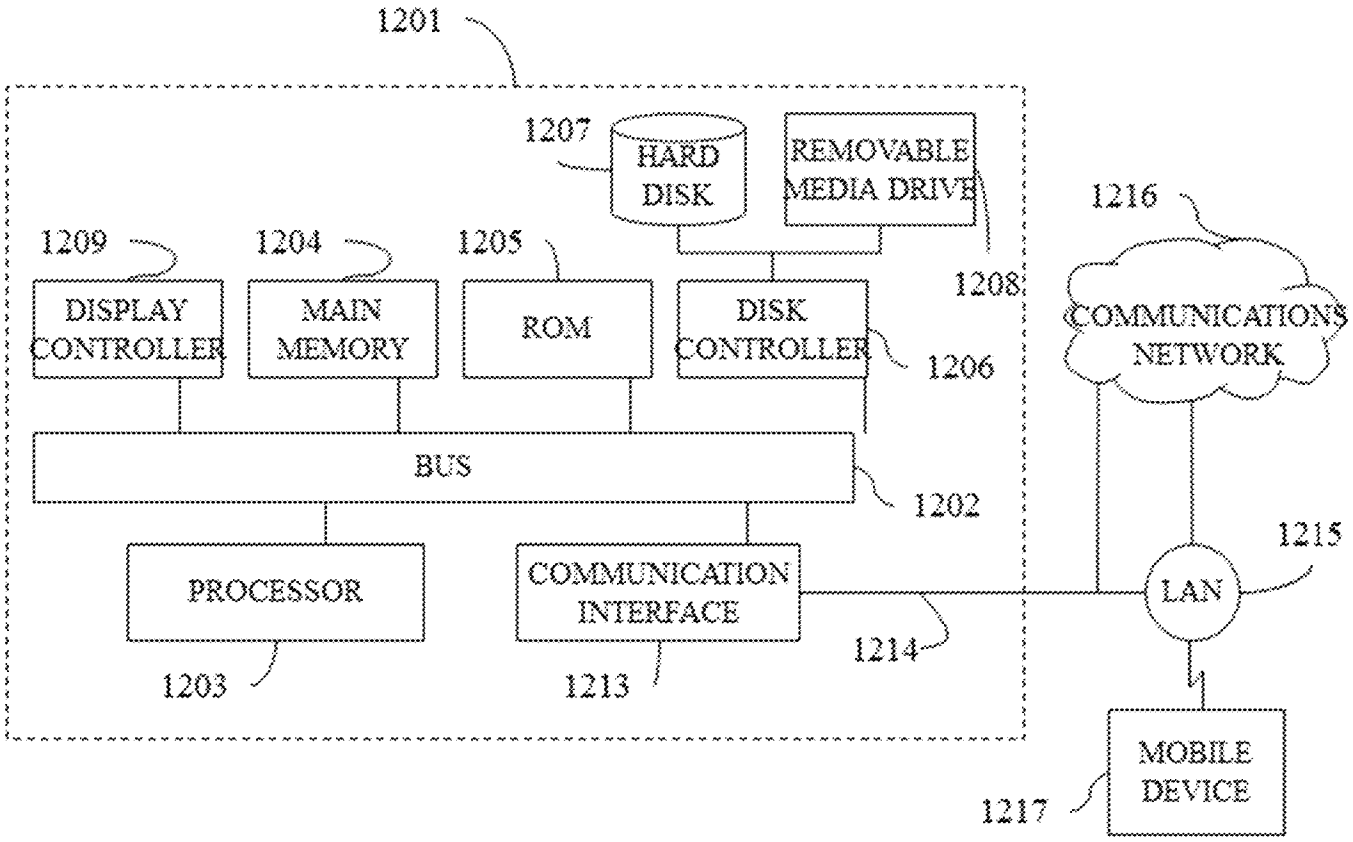
FIG. 8 is a schematic depicting a computer system 1201 for implementing various control and data storage embodiments of the invention.

FIG. 8 is a schematic depicting a computer system 1201 for implementing various control and data storage embodiments of the invention including that of operating the controller 100 noted above.

The computer system 1201 for example may be used as the tracking control 54 to control the tracking of mounting base 52 (or to perform any or all of the other functions described above). The computer system 1201 includes a bus 1202 or other communication mechanism for communicating information, and a processor 1203 coupled with the bus 1202 for processing the information. The computer system 1201 also includes a main memory 1204, such as a random access memory (RAM) or other dynamic storage device (e.g., dynamic RAM (DRAM), static RAM (SRAM), and synchronous DRAM (SDRAM)), coupled to the bus 1202 for storing information and instructions to be executed by processor 1203. In addition, the main memory 1204 may be used for storing temporary variables or other intermediate information during the execution of instructions by the processor 1203. The computer system 1201 further includes a read only memory (ROM) 1205 or other static storage device (e.g., programmable read only memory (PROM), erasable PROM (EPROM), and electrically erasable PROM (EEPROM)) coupled to the bus 1202 for storing static information and instructions for the processor 1203.

The computer system 1201 also includes a disk controller 1206 coupled to the bus 1202 to control one or more storage devices for storing information and instructions, such as a magnetic hard disk 1207, and a removable media drive 1208 (e.g., floppy disk drive, read-only compact disc drive, read/write compact disc drive, tape drive, and removable magneto-optical drive). The storage devices may be added to the computer system 1201 using an appropriate device interface (e.g., small computer system interface (SCSI), integrated device electronics (IDE), enhanced-IDE (E-IDE), direct memory access (DMA), or ultra-DMA).

The computer system 1201 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)).

The computer system 1201 may also include a display controller 1209 coupled to the bus 1202 to control a display for displaying information to a computer user. The computer system includes input devices, such as a keyboard and a pointing device, for interacting with a computer user and providing information to the processor 1203. The pointing device, for example, may be a mouse, a trackball, or a pointing stick for communicating direction information and command selections to the processor 1203 and for controlling cursor movement on the display.

The computer system 1201 performs control of the RF and DC voltages, laser, CCD camera and X-Y stages (described above) in the sub-APMALDI ionization source 2 in response to the processor 1203 executing one or more sequences of one or more instructions contained in a memory, such as the main memory 1204. Such instructions may be read into the main memory 1204 from another computer readable medium, such as a hard disk 1207 or a removable media drive 1208. One or more processors in a multi-processing arrangement may also be employed to execute the sequences of instructions contained in main memory 1204. In alternative embodiments, hard-wired circuitry may be used in place of or in combination with to software instructions. Thus, embodiments are not limited to any specific combination of hardware circuitry and software.

As stated above, the computer system 1201 includes at least one computer readable medium or memory for holding instructions programmed according to the teachings of the invention and for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other optical medium, punch cards, paper tape, or other physical medium with patterns of holes, a carrier wave (described below), or any other medium from which a computer can read.

Stored on any one or on a combination of computer readable media, the invention includes software for controlling the computer system 1201, for driving a device or devices for implementing the invention, and for enabling the computer system 1201 to interact with a human user who for example may be monitoring the performance of the sub-APMALDI ionization source 2. Such software may include, but is not limited to, device drivers, operating systems, development tools, and applications software. Such computer readable media further includes the computer program product of the invention for performing all or a portion (if processing is distributed) of the processing performed in implementing the invention.

A computer readable medium may take many forms, including but not limited to, non-volatile media, volatile media, and transmission media. Non-volatile media includes, for example, optical, magnetic disks, and magneto-optical disks, such as the hard disk 1207 or the removable media drive 1208. Volatile media includes dynamic memory, such as the main memory 1204. Transmission media includes coaxial cables, copper wire and fiber optics, including the wires that make up the bus 1202. Transmission media also may also take the form of acoustic or light waves, such as those generated during radio wave and infrared data communications.

The computer system 1201 can also include a communication interface 1213 coupled to the bus 1202. The communication interface 1213 provides a two-way data communication coupling to a network link 1214 that is connected to, for example, a local area network (LAN) 1215, or to another communications network 1216 such as the Internet. These local and non-local communications permit the sub-APMALDI ionization source 2 to be connected to other computing resources outside the sub-APMALDI ionization source 2. For example, the communication interface 1213 may be a network interface card to attach to any packet switched LAN. As another example, the communication interface 1213 may be an asymmetrical digital subscriber line (ADSL) card, an integrated services digital network (ISDN) card or a modem to provide a data communication connection to a corresponding type of communications line. Wireless links may also be implemented. In any such implementation, the communication interface 1213 sends and receives electrical, electromagnetic or optical signals that carry digital data streams representing various types of information.

The network link 1214 typically provides data communication through one or more networks to other data devices. For example, the network link 1214 may provide a connection to another computer through a local network 1215 (e.g., a LAN) or through equipment operated by a service provider, which provides communication services through a communications network 1216. The local network 1214 and the communications network 1216 use, for example, electrical, electromagnetic, or optical signals that carry digital data streams, and the associated physical layer (e.g., CAT 5 cable, coaxial cable, optical fiber, etc.). The signals through the various networks and the signals on the network link 1214 and through the communication interface 1213, which carry the digital data to and from the computer system 1201 may be implemented in baseband signals, or carrier wave based signals. The baseband signals convey the digital data as unmodulated electrical pulses that are descriptive of a stream of digital data bits, where the term "bits" is to be construed broadly to mean symbol, where each symbol conveys at least one or more information bits.

Numerous modifications and variations of the present invention are possible in light of the above teachings. It is therefore to be understood that within the scope of the appended claims, the invention may be practiced otherwise than as specifically described herein.

The invention claimed is:

1. An apparatus for sample analysis having a laser ionization source operated at sub-atmospheric pressure conditions, comprising:

a holder configured to hold a sample containing analyte mulches;

a laser ionizer utilizing a pulsed laser configured to generate ionized species from the sample;

an ion extractor adjacent to said holder and configured to create a DC extraction electric field Es and to extract analyte ions from said ionized species; and an ion funnel structure external to said ion extractor comprising orifice electrodes arranged in a direction z and each having an aperture through which an ion funnel pathway extends, said structure having an entrance electrode having an aperture with a size D and an exit electrode, sizes of apertures decreasing from size D of the entrance electrode to the exit electrode, the exit electrode having a smallest aperture; said structure configured to being applied with DC and RF voltages to generate a funnel electric field in the direction z and a radial focusing field, the DC voltages applied to the electrodes generating the funnel electric field, and to accept said analyte ions from the ion extractor at the entrance and transfer at last a portion of the analyte ions toward the exit electrode using the funnel electric field along the direction z and focus the analyte ions using the focusing field; and a vacuum chamber enclosing said holder, said ion extractor, and said ion funnel structure, wherein an operational pressure p in the vacuum chamber is maintained in the pressure range from 0.01 to 100 Torr, wherein the extraction electric field near the sample is at last twice as large as the funnel electric field at any point within the ion funnel structure.

2. The apparatus as in claim 1, further comprising a spectrometer for analysis of the analyte ions at the exit of the ion funnel structure and comprising at least one of a mass spectrometer, a tandem mass spectrometer, and an ion mobility spectrometer.

3. The apparatus as in claim 1, wherein said sample includes at least one of biomolecule, protein, peptide, lipid, polymer molecule, small chemical molecule, and biological tissue.

4. The apparatus as in claim 1, wherein said operational pressure p is in the range from 0.5 Torr to 5 Torr.

5. The apparatus as in claim 1, wherein said operational pressure p is in the range from 0.1 Torr to 30 Torr.

6. The apparatus as in claim 1, wherein a wavelength of said pulsed laser beam is in at least one of infrared, visible and ultraviolet wavelength ranges.

7. The apparatus as in claim 1, wherein a firing frequency of said pulsed laser beam is higher than 1,000 Hz.

8. The apparatus as in claim 1 wherein said laser ionizer is based on at least one of the following ionization techniques: matrix-assisted laser desorption/ionization (MALDI), direct laser ionization (DLI), nanostructure-assisted laser desorption/ionization (NALDI), surface-enhanced laser/desorption ionization (SELDI), surface-assisted laser/desorption ionization (SALDI), and desorption/ionization on silicon (DIOS).

9. The apparatus as in claim 1, wherein the holder is a plate containing multiple samples for analysis.

10. The apparatus as in claim 1, wherein the ion extractor includes at least one of an electrostatic electrode, a multipole ion guide, an ion tunnel guide, and an adjacent ion funnel.

11. The apparatus as in claim 10, wherein the ion extractor includes more than one electrostatic lens.

12. The apparatus as in claim 10, wherein said multipole ion guide is a segmented multipole ion guide.

13. The apparatus as in claim 10, wherein said adjacent ion funnel is a part of the ion funnel structure.

14. The apparatus as in claim 1, wherein said extraction electric field Es is in general parallel to the direction z of the ion funnel structure.

15. The apparatus as in claim 1, wherein said extraction electric field Es is in general perpendicular to the direction z of the ion funnel structure.

16. The apparatus as in claim 8, wherein apparatus comprises a controller configured to control said DC extraction electric field Es in said MALDI ionizer to be at or greater than an electric field threshold for extraction of said analyte ions from the ionized species.

17. The apparatus as in claim 8, wherein said apparatus comprises a controller configured to control the DC extraction electric field Es in said MALDI ionizer to be at least twice greater than an electric field threshold for extraction of said analyte ions from the ionized species.

18. The apparatus as in claim 1, wherein said DC extraction electric field Es is near an electric breakdown limit at the operational pressure p.

19. The apparatus as in claim 1, wherein Es/p >40 V/(Torr-cm).

20. The apparatus as in claim 1, further comprising a grid located at the entrance to the ion funnel structure.

21. The apparatus as in claim 1, wherein the entrance to the ion funnel structure is gridless.

22. The apparatus as in claim 21, wherein a distance from the sample to the ion funnel entrance is larger than the entrance size D.

23. The apparatus as in claim 1, wherein the extraction electric field Es is completely shielded from the funnel electric field.

24. The apparatus as in claim 1, wherein the extraction electric field Es is partially shielded from the funnel electric field.

25. A method for sample analysis utilizing a laser ionization source operated at a sub-atmospheric pressure range and a spectrometer, comprising:

placing a sample containing analyte molecules on a holder;

generating ionized species from said sample using a laser ionization technique;

extracting analyte ions from said ionized species by an extraction electric field Es near the sample;

directing the extracted analyte ions into an ion funnel structure having an entrance and an exit, the structure being comprising orifice electrodes each having an aperture through which an ion funnel pathway extends in an ion funnel pathway direction, said structure having an entrance electrode having an aperture with size D and an exit electrode, sizes of apertures generally decreasing from the size D to a smallest aperture of said exit electrode;

applying DC voltages to the orifice electrodes generating an axial electric field Ez transferring ions toward the exit electrode; and transferring said extracted analyte ions from the entrance to the exit of said ion funnel structure by the axial electric field Ez along the funnel pathway direction for analysis, wherein said extraction electric field Es is at least twice that of the axial electric field Ez.

26. The method as in claim 25 wherein said laser ionization technique is at least one of matrix-assisted laser desorption/ionization (MALDI), direct laser ionization (DLI), nanostructure-assisted laser desorption/ionization (NALDI), surface-enhanced laser/desorption ionization (SELDI), surface-assisted laser/desorption ionization (SALDI), and desorption/ionization on silicon (DIOS).

27. The method as in claim 26 wherein said extraction electric field Es in said MALDI ionization technique is at or greater than an electric field threshold for extraction of said analyte ions from the ionized species.

28. The method as in claim 26 wherein said extraction electric field Es in said MALDI ionization technique is at least two times greater than an electric field threshold for extraction of said analyte ions from the ionized species.

29. The method as in claim 25, wherein the extraction electric field Es is completely shielded from the axial electric field Ez.

30. The method as in claim 25, wherein the extraction electric field Es is partially shielded from the axial electric field Ez.

31. An apparatus for sample analysis having a laser ionization source operated at sub-atmospheric pressure conditions, comprising:

a holder configured to hold a sample containing analyte molecules;

a laser ionizer utilizing a pulsed laser configured to generate ionized species from the sample;

an ion extractor adjacent to said holder and configured to create a DC extraction electric field Es and to extract analyte ions from said ionized species; and an ion funnel structure comprising orifice electrodes located along an ion funnel pathway direction z; said structure having an entrance electrode having an aperture with a size D and an exit electrode, the exit electrode having a smallest aperture in the structure; said structure configured to accept said analyte ions at the entrance and transfer at least a portion of the analyte ions toward the exit using an axial electric field Ez along the direction z produced by applying DC voltages to the electrodes generating the axial electric field Ez transferring portion of the analyte ions toward the exit electrode;

a controller programmed to control an average axial electric field from the entrance to the exit inside the structure <Ez>; and a vacuum chamber enclosing said holder, said ion extractor, and said ion funnel structure, wherein an operational pressure p in the vacuum chamber is maintained in the pressure range from 0.01 to 100 Torr, wherein the average axial electric field <Ez> is at least twice smaller than the extraction electric field Es.

32. The apparatus as in claim 1, comprising the apparatus being configured to apply DC voltages to the ion extractor and ion funnel structure monotonically decreasing from an entrance of the ion extractor to said exit electrode.

33. The apparatus as in claim 8 wherein said apparatus comprises a controller configured to control the extraction electric field Es in said MALDI ionization technique to be at or greater than an electric field threshold for extraction of said analyte ions from the ionized species based upon a mass/charge ratio of said analyte ions.

34. The method as in claim 26 wherein said extraction electric field Es in said MALDI ionization technique is set at or greater than an electric field threshold for extraction of said analyte ions from the ionized species based upon a mass/charge ratio of said analyte ions.

35. The apparatus as in claim 8 wherein said extraction electric field Es in said MALDI ionization technique is in a range of about 40-50 V/cm.

36. The method as in claim 26 wherein said extraction electric field Es in said MALDI ionization technique is in a range of about 40-50 V/cm.

* * * * *